US006289704B1

(12) United States Patent
Collet et al.

(10) Patent No.: US 6,289,704 B1
(45) Date of Patent: Sep. 18, 2001

(54) ESPAGNOLETTE OR ESPAGNOLETTE-LOCK FOR A DOOR, FRENCH WINDOW OR THE LIKE

(75) Inventors: Jean-Yves Collet, Saint-Jean-Savern; Gerard Prevot, deceased, late of Willerwald, both of (FR), by Nadine Prevot, legal representative

(73) Assignee: Ferco International Ferrures et Serrures de Batiment Societe Anonyme, Sarrebourg (FR)

( * ) Notice: Subject to any disclaimer, the term of this patent is extended or adjusted under 35 U.S.C. 154(b) by 0 days.

(21) Appl. No.: 09/216,986

(22) Filed: Dec. 21, 1998

(30) Foreign Application Priority Data

Jan. 9, 1998 (FR) ..... 98 00284

(51) Int. Cl.[7] ..... E05B 59/00
(52) U.S. Cl. ..... 70/107; 70/134; 292/39
(58) Field of Search ..... 70/89, 90, 107–110, 70/129, 134; 292/32–36, 39, 40

(56) References Cited

U.S. PATENT DOCUMENTS 3,477,755 * 11/1969 Russell et al. ..... 70/107 X
4,962,653 * 10/1990 Kaup ..... 70/107
5,171,047 * 12/1992 Korb et al. ..... 292/39
5,265,920 * 11/1993 Kaup et al. ..... 70/107 X
5,765,410 * 6/1998 Kwan et al. ..... 70/107
5,782,114 * 7/1998 Zeus et al. ..... 292/34 X
5,819,562 * 10/1998 Christ ..... 292/34 X
5,896,763 * 4/1999 Dinkelborg et al. ..... 70/108 X

FOREIGN PATENT DOCUMENTS

3836694 * 5/1990 (DE) ..... 70/107
3903633 * 8/1990 (DE) ..... 70/107

* cited by examiner

*Primary Examiner*—Suzanne Dino Barrett
(74) *Attorney, Agent, or Firm*—Harrison & Egbert

(57) ABSTRACT

An espagnolette-lock for use on a leaf within a sash-frame having a casing, an operating rod movable between a locked position and an unlocked position, a controller for actuating the operating rod, a springy element for automatically restoring the operating rod to the locked position, a manual controller for moving the operating rod to the unlocked position and for restoring the springy element to a compressed condition, a locking mechanism for maintaining the operating rod in the unlocked position during an opening of the leaf from the sash-frame, and an unlocking mechanism for releasing the locking mechanism when the leaf is closed into the sash-frame so as to return the operating rod to the locked position. The locking mechanism includes a toggle joint having a first rod and a second rod connected together by a fulcrum. The first rod is connected through a hinged joint to the operating rod. The second rod is connected through a hinged joint to the casing. The fulcrum and the respective hinged joints are substantially in alignment parallel to the operating rod when the operating rod is in the unlocked position.

9 Claims, 3 Drawing Sheets

ESPAGNOLETTE OR ESPAGNOLETTE-LOCK FOR A DOOR, FRENCH WINDOW OR THE LIKE

BACKGROUND OF THE INVENTION (1) Field of the Invention

The invention relates to an espagnolette or espagnolette-lock for a door, French window or the like, comprising, accommodated in a central casing, a control mechanism designed so as to be capable of actuating at least one operating rod and including, springy means for automatically restoring the operating rod into its locking position, as well as manual control means. The control means is a tumbler actuated through a control handle, for ensuring the unlocking of this operating rod and resetting of the springy means. The invention further includes a locking device capable of maintaining the operating rod in its unlocked position upon opening of the leaf of the door, French window or the like. The invention also includes unlocking means capable of releasing the locking device when closing the leaf against the sash-frame, in order to allow the restoring of the operating rod into its locking position.

This invention will find its application in the field of the building iron-mongery and in particular relates to locking fittings.

(2) Description of the Prior Art

One should indeed note that there are already known espagnolettes or espagnolettes-locks meeting the above description. Such espagnolettes facilitate the locking of the door, French window or the like in that the operating rod or rods are automatically pushed back into their locking position under the action of springy restoring means the action of which is, released at the very moment at which the leaf is closed against the sash-frame. When unlocking and opening this leaf, the action performed by the user on a control handle results into bringing this or these operating rods into their unlocked position and in ensuring the resetting of the aforementioned springy means, while an adequate locking device simultaneously maintains the operating rod or rods in this unlocked position against the action of the spring which substantially forms the springy restoring means.

Finally, such an espagnolette also includes unlocking means which are capable of releasing the locking device when closing the leaf against the sash-frame, in order to allow the restoring of these operating rods into their locking position.

An espagnolette meeting this description is already known. In particular, the locking device consists of a locking pawl which is tiltingly fitted at the level of a face-plate which usually covers the various ogans of the espagnolette or espagnolette-lock at the front edge of the leaf. This locking pawl acts in the direction of moving of this leaf, so that, when opening the leaf, it automatically tilts towards the sash-frame, this under the action of a spring, whereas, when closing this leaf, the sash-frame is capable of pushing back this locking pawl against the spring.

One should note that such a locking pawl is extended, by a lever through which it is capable of maintaining the operating rod or rods in an unlocked position, this at the very moment at which the leaf is opened and, hence, as soon as this locking pawl could be released from the sash-frame.

Such a solution has the drawback that the release mechanism is dissociated from a locking organ of the espagnolette or espagnolette-lock. This results in non-synchronous actions between the release mechanism and, the spring-bolt, which is the first of these locking organs that enters into contact with a keeper of the sash-frame. Therefore, any one of these members can strike against an organ of the sash-frame, e.g. a keeper.

In addition, such a locking pawl must, alone and through its locking lever arranged inside the casing, act against the action of the springy restoring means restoring the operating rods into their locking position.

SUMMARY OF THE INVENTION

The inventive step of this invention separates the function of maintaining the operating rods in the unlocked position from the releasing this retaining function when closing the leaf against the sash-frame.

To this end, the invention relates to an espagnolette or espagnolette-lock for a door, French window or the like, comprising, accommodated in a central casing, a control mechanism designed so as to be capable of actuating at least one operating rod. The control mechanism includes springy means for automatically restoring the operating rod into its locking position, as well as manual control means. The manual control means is a tumbler actuated through a control handle, for ensuring the unlocking of this operating rod and resetting the springy means. The invention further includes a locking device capable of maintaining the operating rod in its unlocked position upon opening of the leaf and unlocking means capable of releasing the locking device when closing the leaf against the sash-frame, in order to allow the restoring of the operating rod into its locking position. The locking device includes a toggle joint comprised of at least two rods connected to each other by means of a fulcrum. One of these rods are made integral, through a hinged joint, with the operating rod or with a support connected to the operating rod, whereas the other rod is made integral, through a hinged joint, with the casing. In unlocking position of the operating rod, the fulcrum and both hinged joints of this toggle joint are located substantially in the same alignment parallel to the direction of travelling of the operating rod or of the support, in order to sustain the toggel joint in an unstable balance position.

As regards the unlocking means, these substantially include a control pawl capable of pushing back the when the latter is in its unstable balance position, in order to allow the locking of the operating rod under the action of the springy means. This control pawl is associated to a spring-bolt subjected to a spring for restoring into locking position and including a retaining organ capable of maintaining this spring-bolt in an unlocked or partially unlocked position. This retaining organ being designed so as to be capable of co-operating, directly or indirectly, with this sash-frame when closing the leaf, in order to release the spring-bolt and to ensure, under the action of the control pawl associated with the retaining organ, the locking of the operating rod.

The advantages resulting from this invention include that the operating rods are maintained in their unlocked position, against the action of the springy means, through a mechanical unit which is in an unstable balance position and which can therefore easily be brought into unbalance under a light action. Therefore, to impart this action, it is necessary to use the restoring spring, which is finally of poor stiffness and systematically brings the spring-bolt back into locking position. Because of this poor stiffness of the restoring spring of the locking bolt, the locking can bolt easily be maintained in its unlocked or partially unlocked position when the leaf is open. To this end, the retaining organ can be of a small size and easily actuated by the sash-frame, in particular by the keeper which the spring-bolt with when closing this leaf.

Further aims and advantages of this invention will become clear when reading the following description which relates to an embodiment which is given only by way of an indication and a non-exhaustive example.

This description will be better understood when referring to the attached drawings.

BRIEF DESCRIPTION OF THE DRAWINGS

FIG. 5 is a schematic plan view of a spring blade associated with the spring-bolt in order to restore into active position the retaining organ the latter is provided with is provided with;

DESCRIPTION OF THE PREFERRED EMBODIMENTS

Figure 1:
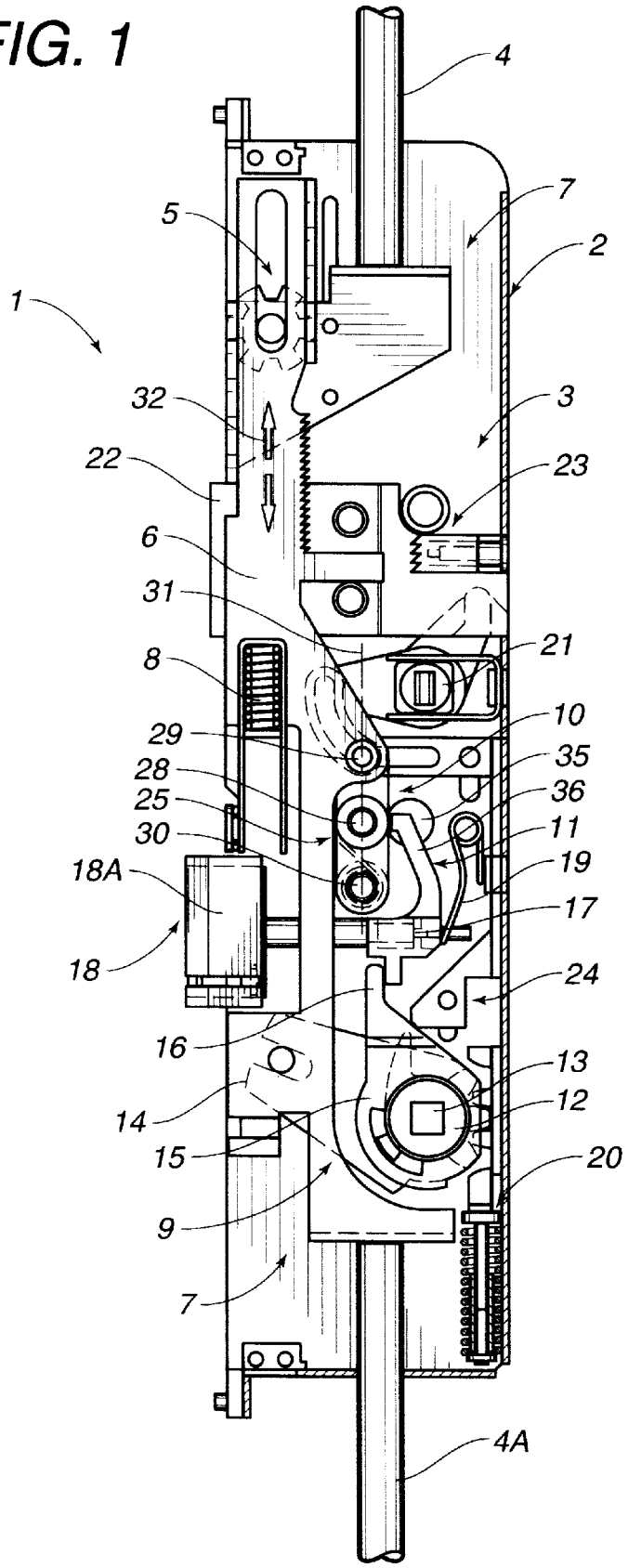
FIG. 1 is a schematic view of the control mechanism of an espagnolette, in particular an espagnolette-lock, according to this invention.
Figure 2:
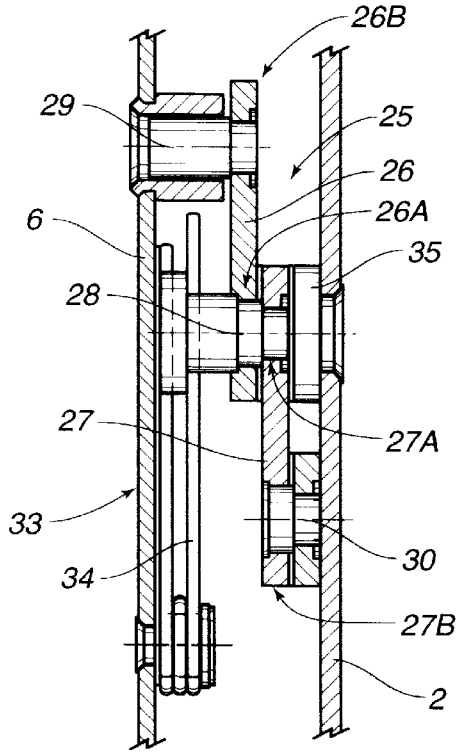
FIG. 2 is a schematic cross-sectional view of the toggle joint forming the locking device aimed at ensuring the maintaining of the operating rod or rods in unlocked position against the action of the springy means for restoring into locking position.
Figure 3:
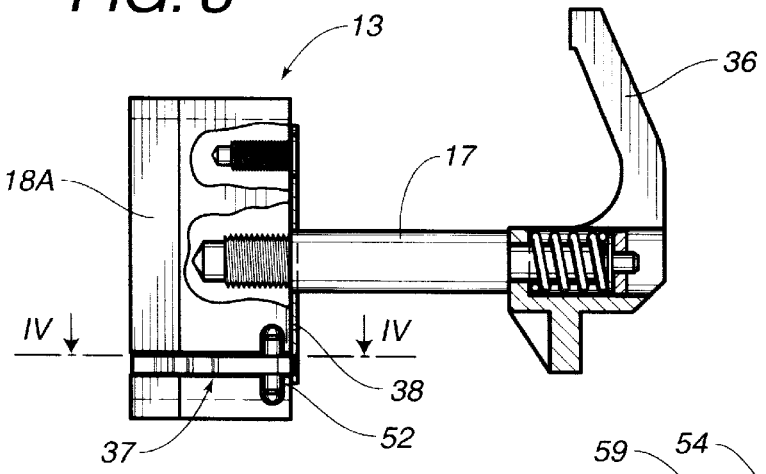
FIG. 3 is a schematic, partly cross-sectional view of the spring-bolt receiving the unlocking means capable of releasing the locking device in the shape of a toggle joint.
Figure 4:
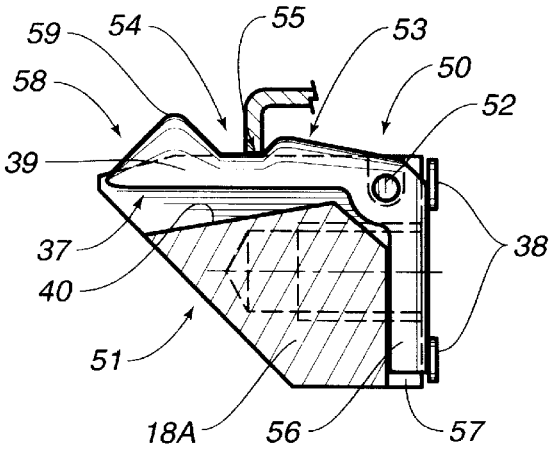
FIG. 4 is a schematic cross-sectional view according to IV—IV of FIG. 3.

As shown in FIG. 1, this invention relates to an espagnolette or espagnolette-lock 1 for a door, French window or the like, comprising, accommodated in a central casing 2, a control mechanism 3 capable of actuating at least one operating rod 4, 4A.

In this respect, the espagnolette or espagnolette-lock 1 may be provided with one operating rod extending above and/or below the central casing 2, as well as it may be provided, as shown in FIG. 1, with two operating rods extending, respectively, above and/or below said central casing 2 and which, through the control mechanism 3, may be caused to move in one and the same direction or in opposite directions. In this latter case, this control mechanism 3 of the espagnolette or espagnolette-lock 1 acts on one of the operating rods 4 through a motion reverser 5.

In addition, this control mechanism 3 can act on the operating rods 4, 4A, either directly or by means of a support 6 accommodated in the casing 2 and connected at its ends, through adequate connecting means 7, to this or these operating rods 4, 4A.

This invention more specifically relates to the espagnolettes or espagnolettes-locks the control mechanism 3 of which includes, springy means 8 for automatically restoring these operating rods 4, 4A into locking position and, manual control means 9 for allowing the user to manually ensure the unlocking of these operating rods 4, 4A and the resetting of the springy means 8.

In this respect, this espagnolette or espagnolette-lock 1 also includes a locking device 10 capable of maintaining the operating rods 4, 4A in their unlocked postion upon opening of the leaf corresponding to the door, French window or the like, as well as unlocking means 11 capable of releasing this locking device 10 when closing the leaf against the sash-frame and of thus allowng the restoring of the operating rods 4, 4A into the locking position.

The manual control means 9 are formed by a tumbler 12 including a recess 13 for receiving an operating square of a control handle. This tumbler 12 acts on the operating rods 4, 4A through the support 6, by means of a driving organ 14 of an adequate configuration. On this tumbler 12 may also be fitted a crown 15 provided with an actuating pawl 16 capable of acting on the stem 17 of a spring-bolt 18 which is pushed back into its locking position under the action of a restoring spring 19.

In this respect, springy restoring means 20 can also act on the tumbler to systematically restore the tumbler 12 and, hence, the control handle, into a resting position upon a locking or unlocking action.

The manual control means 9 can also assist the springy means 8 in restoring the operating rods 4, 4A into their locking position. In particular, when these operating rods 4, 4A meet a hindrance preventing co-operation with the keeper accordingly arranged on the sash-frame, it may occur that the pushing force exerted by these springy restoring means 8 is insufficient to overcome this hindrance. In that case the action can be completed through the manual control means 9.

Within the framework of an espagnolette-lock, the espagnolette-lock also receives a key-operated member 21 capable of acting, on a dead bolt 22 and/or on means 23 for locking the operating rods 4, 4A in locking position and/or means 24 for locking the tumbler 12 in rotation in the direction corresponding to an unlocking action.

This being said, according to a peculiar feature of this invention, the locking device 10 which maintains the operating rods 4, 4A in unlocked position against the action of the springy means 8, upon opening of the leaf, include a toggle joint 25. The toggle joint 25 is comprised of at least two rods 26, 27 connected to each other by means of a fulcrum 28, at the level of their one end 26A, 27A. It should be known that one rod 26 of these rods is, at its opposite end 26B, connected, through a hinged joint 29, with the operating rods 4 or 4A. As regards the other rod 27, it is connected, at its end 27B and through a hinged joint 30, with the casing 2. In addition, these members are so arranged that the fulcrum 28 and both hinged joints 29, 30 of this toggle joint 25 are, in the unlocked position of the operating rods 4, 4A, located substantially in one and the same alignment 31 parallel to the direction of travelling 32 of these operating rods 4, 4A or of the support 6, in order to sustain the latter in an unstable balance position.

This espagnolette or espagnolette-lock 1, advantageously includes, assisting means 33 for ensuring the maintaining of this toggle joint 25 in this unstable balance position during the full period in which the leaf of the door remains open and until this unstable balance is voluntarily broken by the unlocking means 11 which release the locking device 10 when closing the leaf against its sash-frame.

According to a preferred embodiment, these assisting means 33 include a spring 34 of poor stiffness which causes the toggle joint 25 to rest its fulcrum against a stop 35 within casing 2.

As regards the unlocking means 11, these are, as already stated above, so designed as to break this unstable balance of the toggle joint 25, in a direction opposite the stop 35, the very moment of closing the leaf against its sash-frame, in order to allow the operating rods 4, 4A to automatically return into their locking position. According to the invention, the unlocking means 11 includes a control pawl 36, connected with the stem 17 of the spring-bolt 18, which through spring 19, restores aimed at said spring-bolt 18 into its locking position, of pushing back the toggle joint 25, so as to slightly offset the fulcrum 28 with respect to the alignment 31 of the hinged joints 29, 30. This results, with respect to this fulcrum 28, into a torque exerted by the rods 26, 27 under the action of the support 6 pushed back by the springy means 8.

Such unlocking means 11 further include with a retaining organ 37 capable of retaining the spring-bolt 18 in an unlocked or partially locked position when the leaf is open. This retaining organ 37, which is automatically restored into an active position under the action of a restoring spring 38, is, in addition, designed so as to be controlled, and thus released, to release the spring-bolt 18 from the sash-frame, preferably from the keeper.

According to an advantageous embodiment, this retaining organ 37 is directly integrated into the head 18A of the spring-bolt 18 and is in the shape of a lever 39 accommodated in a groove 40 provided for at the level of the back face 50, opposite the bevelled one 51 of this head 18A of the spring-bolt 18. This groove 40 and, thus, said lever 39 extend parallelled to the direction of travelling of the spring bolt. This lever 39 is indeed pivotingly fitted in this groove 40, about a vertical axis 52, perpendicularly to the direction of travelling of the spring-bolt 18.

In addition, the outer edge 53 of this lever 39 is provided with a cut-out 54 capable of co-operating, in active position of this retaining organ 37, with a retaining rim 55 provided on the casing 2.

Figure 5:
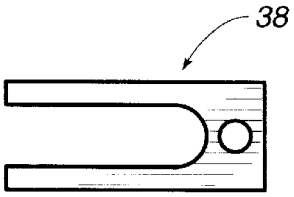

Finally, the lever 39 is extended, beyond its axis 52, by a bend 56 on which acts the restoring spring 38, preferably, in the shape of a blade spring fixed at the rear of the head 18A of the spring-bolt 18. The shape of this blade spring 38 has been shown in FIG. 5.

One should in fact note that this bend 56 extending the lever 39 beyond its axis 52 is also accommodated in a groove 57 which extends, in this case, at the rear of the head 18A of the spring-bolt 18. The bottom of this groove 57 acts as a stop against which the bend 56 is applied under the action of the blade spring 38, corresponding to the active position of the retaining organ 37.

In addition, in order to allow the retaining organ 37 to withdraw when the spring-bolt 18 moves back, the outer edge 53 of the lever 39 in front of the retaining rim 55 is of a shape defined without a set-back for allowing this action.

Finally, the lever 39 is also designed so as to be capable of co-operating with the sash-frame, in particular with the keeper aimed at receiving the spring-bolt 18, when closing the leaf, in order to release the spring-bolt 18. This lever 39 therefore includes, along its portion 58 remaining in any case protruding with respect to the front edge of the casing 2, a control pawl 59 in the shape of a protrusion at its outer edge 53. This control pawl 59 is indeed protruding with respect to the back face 50 of the head 18A of the spring-bolt 18 and, hence, is oriented towards the sash-frame of the door.

Thus, the way of operating of such an espagnolette or espagnolette-lock 1 includes is as follows. Starting from the locking position adopted when the door or window is closed, after unlocking the key-operated member 21, in actuating the control means 9, results into unlocking the operating rods 4, 4A and resetting the springy means 8. The toggle joint 25 is brought into its unstable balance position resulting from the alignment of its fulcrum 28 with respect to the hinged joints 29, 30. This toggle joint 25 is then maintained in this unstable balance position through the assisting means 33 defined by the spring 34 capable of maintaining the fulcrum 28 of the toggle joint 25 against the stop 35.

The action then exerted by the user on the control handle, and hence on the tumbler 12, which substantially defines the manual control means 9, leads to the moving back of the spring-bolt 18, so that the leaf can then be opened.

When the user releases his action on said control handle, the spring-bolt 18 tends, under the action of the spring 19, to return into its locking position. Then enters into operation the retaining organ 37 which, being maintained in active position by the restoring spring 38, co-operates with the retaining rim 55 provided on the casing 2, in order to retain said spring-bolt 18 in its unlocked or, preferably, partially unlocked position.

Figure 6:
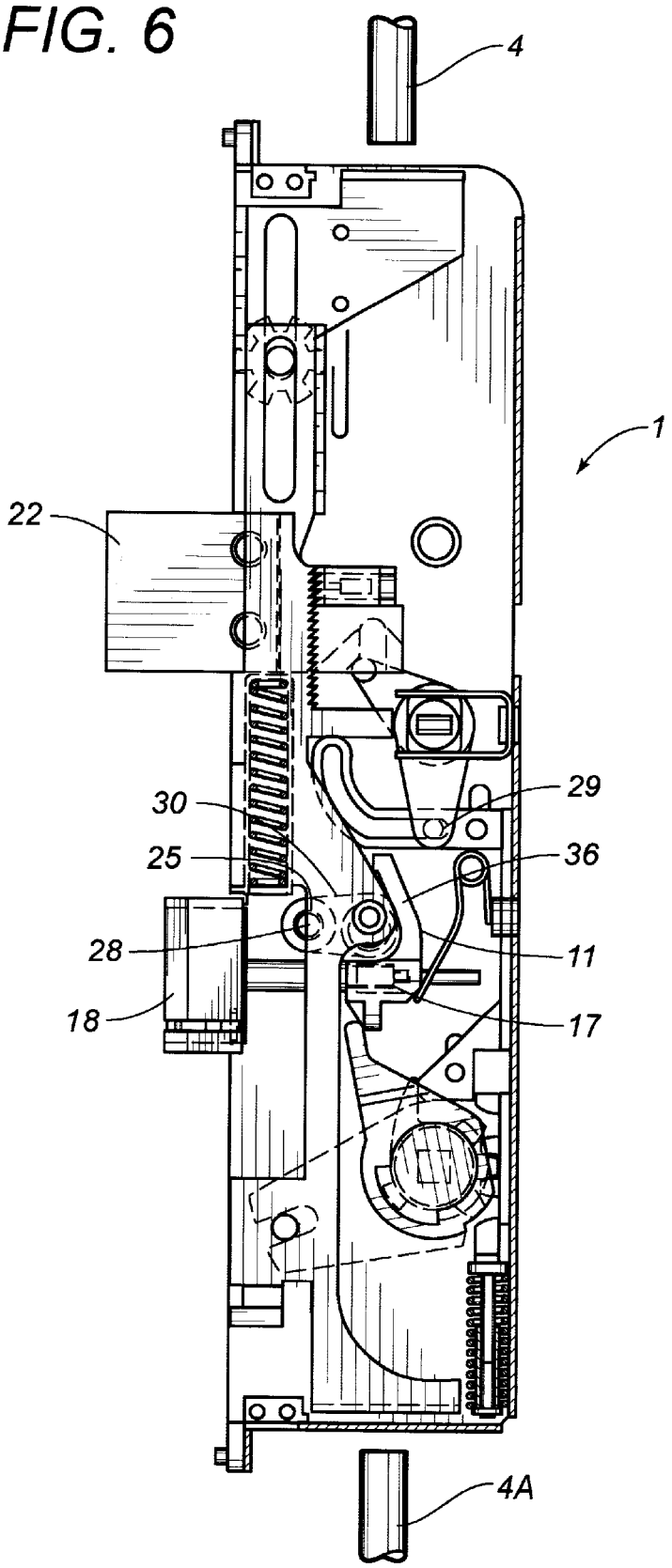
FIG. 6 is a partial cross-sectional view of the control mechanism of an espagnolle according to the invention showing, in particular, the foldback position of the toggle joint.

When closing the leaf against the sash-frame, the action of the keeper on the bevelled face 51 of the spring-lock 18 first of all causes the spring-lock 18 to move back. Then, when this spring-bolt 18 is capable of penetrating into this keeper, the spring-lock 18 automatically actuates the control pawl 59 of the level 39, so as to cause the retaining organ 37 to be inactive. This allows this spring-bolt 18 to reach its fully locked position, causing the control pawl 36 integral with the stem 17 of this spring-bolt to push back the toggle joint 25 and, thus, to offset it with respect to the unstable balance position. This releases the springy means 8 to ensure the restoring of the operating rods 4, 4A into locking position. FIG. 6 shows the fold-back position of the toggle joint 25. When the spring-bolt 18 (initially retained in a locked or partially-locked position) has been released under the action of the sash-frame or keeper, the unlocking means 11 (formed by the control pawl 36 connected to the stem 17 of the spring-bolt 18) pushes back the intermediate pivot 28 of the toggle joint 25. Since the joints 29 and 30 are no longer in alignment, the toggle joint 25 no longer opposes the restoring of the operating rods 4, 4A into the locking position under the action of the springy means.

We claim:

1. An espagnolette-lock for use on a leaf within a sash-frame comprising:

a casing;

an operating rod movable between a locked position and an unlocked position;

a control means for actuating said operating rod, said control means positioned within said casing;

springy means for automatically restoring said operating rod to said locked position, said springy means positioned within said casing;

manual control means for moving said operating rod to said unlocked position and for resetting said springy means to a compressed condition, said manual control means received within said casing, said manual control means comprising a tumbler being actuatable by a control handle;

a locking means for maintaining said operating rod in said unlocked position during an opening of the leaf from the sash-frame, said locking means positioned within said casing; and unlocking means for releasing said locking means when the leaf is closed into the sash-frame so as to return said operating rod to said locked position, said locking means comprising:

a toggle joint having a first rod and a second rod connected together by a fulcrum, said first rod being connected through a hinged joint to said operating rod, said second rod being connected through a hinged joint to said casing, said fulcrum and the respective hinged joints of said first and second rods being substantially in alignment parallel to said operating rod when said operating rod is in said unlocked position such that said toggle joint is in an unstable balance position.

2. The espagnolette-lock of claim 1, said first rod being connected through said hinged joint of said first rod to a support connected to said operating rod, said support being movable in a direction within said casing, said fulcrum and the repective hinged joints of said first and second rods being in alignment parallel to said direction when said operating rod is in said unlocked position.

3. The espagnolette-lock of claim 1, further comprising:

assisting means for maintaining said toggle joint in said unstable balance position when the leaf is open from the sash-frame, said unlocking means for breaking said unstable balance position of said toggle joint when the leaf is closed into said sash-frame.

4. The espagnolette-lock of claim 3, said assisting means comprising:

a spring resiliently acting on said fulcrum of said toggle joint when in said unstable balance position.

5. The espagnolette-lock of claim 1, further comprising:

a spring-bolt movable between a locking position and a unlocking position, said spring-bolt received within said casing, said spring-bolt being urged by a spring to said locking position, said unlocking means comprisng a control pawl connected to a stem of said spring-bolt, said control pawl being cooperative with said toggle joint so as to offset said fulcrum thereof when said spring moves said spring-bolt to said locking position, said unlocking means further comprising a retaining organ means for retaining said spring-bolt in said unlocking position when the leaf is opened from the sash-frame, said retaining organ means cooperative with said spring-bolt so as to release said spring-bolt to said locking position when the leaf is closed into the sash-frame.

6. The espagnolette-lock of claim 5, said spring-bolt having a head connected to said retaining organ means, said head having a groove formed in a back face thereof, said groove pivotally receiving a lever therein, said back face being opposite a beveled face of said head, said groove extending parallel to a direction of travel of said spring-bolt, said lever being pivotally mounted within said groove about an axis perpendicular to said direction of travel, said level having an outer edge with a cut-out cooperative with a retaining rim of said casing.

7. The espagnolette-lock of claim 5, said retaining organ means movable between an active position and an inactive position, said retaining organ means comprising a restoring spring resiliently urging said retaining organ means to said active position.

8. The espagnolette-lock of claim 7, said lever having a bend on a side of said axis opposite said cut-out, said bend being cooperative with said restoring spring.

9. The espagnolette-lock of claim 8, said head having a slot formed at a rear thereof, said bend received with said slot, said slot having a bottom acting as a stop against said bend, said restoring spring urging said bend against said bottom.

* * * * *